US007208068B2

(12) United States Patent
Nisogi et al.

(10) Patent No.: US 7,208,068 B2
(45) **Date of Patent: *Apr. 24, 2007**

(54) DULLISH COATED PAPER FOR PRINTING

(75) Inventors: Hideaki Nisogi, Tokyo (JP); Jun Makihara, Tokyo (JP); Yukiko Ohira, Tokyo (JP); Hirokazu Morii, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/500,087

(22) PCT Filed: Dec. 26, 2002

(86) PCT No.: PCT/JP02/13572

§ 371 (c)(1),
(2), (4) Date: Sep. 13, 2004

(87) PCT Pub. No.: WO03/056101

PCT Pub. Date: Jul. 10, 2003

(65) Prior Publication Data

US 2005/0016701 A1 Jan. 27, 2005

(30) Foreign Application Priority Data

Dec. 26, 2001 (JP) ..... 2001-393488

(51) Int. Cl.
*D21H 21/22* (2006.01)
*D21H 25/06* (2006.01)
*D21H 17/06* (2006.01)
*D21H 17/07* (2006.01)

(52) U.S. Cl. ..... 162/135; 162/158; 162/179; 162/181.1; 162/164.1; 162/206; 428/206; 428/341; 427/361; 427/365

(58) Field of Classification Search ..... 162/135, 162/158, 164.1, 164.6, 168.2, 179, 181.1, 162/181.2, 181.8, 204–207, 181; 428/195.1, 428/537.5, 206, 340–341; 427/361, 391, 427/358, 365–366, 35
See application file for complete search history.

(56) References Cited

U.S. PATENT DOCUMENTS

| | | | | | |
|---|---|---|---|---|---|
| 4,154,899 | A * | 5/1979 | Hershey et al. | 428/537.5 |
| 4,157,995 | A * | 6/1979 | Schenck et al. | 524/513 |
| 4,682,983 | A * | 7/1987 | Mehl | 8/468 |
| 4,867,844 | A * | 9/1989 | Dessauer | 162/135 |
| 4,908,240 | A * | 3/1990 | Auhorn et al. | 427/391 |
| 4,963,192 | A * | 10/1990 | Dessauer | 106/499 |
| 5,168,034 | A * | 12/1992 | Tamagawa et al. | 430/536 |
| 5,185,202 | A * | 2/1993 | Serizawa et al. | 428/335 |
| 5,200,258 | A * | 4/1993 | Tamagawa et al. | 428/218 |
| 5,302,249 | A * | 4/1994 | Malhotra et al. | 162/135 |
| 5,362,614 | A * | 11/1994 | Serizawa et al. | 430/538 |
| 5,474,856 | A * | 12/1995 | Tamagawa et al. | 428/537.5 |
| 5,500,191 | A * | 3/1996 | DeMatte | 427/358 |
| 5,786,100 | A * | 7/1998 | Tsuruoka et al. | 428/511 |
| 5,789,031 | A * | 8/1998 | Hirabayashi et al. | 427/341 |
| 5,853,870 | A * | 12/1998 | Uchimura et al. | 428/329 |
| 6,086,987 | A * | 7/2000 | Yamanaka et al. | 428/330 |
| 6,162,329 | A * | 12/2000 | Vinson et al. | 162/158 |
| 6,190,781 | B1 * | 2/2001 | Tsubaki et al. | 428/32.21 |
| 6,207,258 | B1 * | 3/2001 | Varnell | 428/32.1 |
| 6,335,102 | B1 * | 1/2002 | Tsubaki et al. | 428/513 |
| 6,572,951 | B2 * | 6/2003 | Hasegawa et al. | 428/141 |
| 6,586,079 | B1 * | 7/2003 | Shibahara et al. | 428/195.1 |
| 6,880,928 | B2 * | 4/2005 | Hosoi et al. | 347/105 |
| 6,929,845 | B2 * | 8/2005 | Kai et al. | 428/199 |
| 7,101,459 | B2 * | 9/2006 | Nisogi et al. | 162/135 |
| 2002/0051865 | A1 * | 5/2002 | Hasegawa et al. | 428/141 |
| 2003/0227531 | A1 * | 12/2003 | Kai et al. | 428/199 |
| 2004/0045686 | A1 * | 3/2004 | Nisogi et al. | 162/135 |
| 2005/0016701 | A1 * | 1/2005 | Nisogi et al. | 162/135 |
| 2005/0150625 | A1 * | 7/2005 | Ochi et al. | 162/231 |

FOREIGN PATENT DOCUMENTS

| | | | |
|---|---|---|---|
| EP | 860547 | A2 * | 8/1998 |
| EP | 1 001 082 | A1 | 5/2000 |
| EP | 1 016 755 | A2 | 7/2000 |
| JP | 07-126999 | | 5/1995 |
| JP | 11-279988 | | 10/1999 |
| JP | 11-350380 | | 12/1999 |
| JP | 2000-328481 | | 11/2000 |
| JP | 2000-345493 | | 12/2000 |
| JP | 2001-055686 | | 2/2001 |
| JP | 2001-234497 | | 8/2001 |
| JP | 2001-248100 | | 9/2001 |
| JP | 2002-138392 | | 5/2002 |
| WO | WO 02/01000 | A1 | 1/2002 |

* cited by examiner

*Primary Examiner*—José A. Fortuna
(74) *Attorney, Agent, or Firm*—Knobbe, Martens, Olson & Bear LLP

(57) ABSTRACT

A dull coated printing paper that is bulky (low in density) having a density of 0.90 to 1.15 g/cm$^3$ and yet offers excellent pliability, superior surface smoothness, high degree of print gloss and minimal small-scale gloss variations in the image area are obtained by forming a coating layer comprising a pigment and an adhesive on a base paper which contains an organic compound having an action to inhibit binding between pulp fibers and then carrying out calender treatment at a line pressure for the treatment of 50 to 150 kg/cm.

21 Claims, No Drawings

DULLISH COATED PAPER FOR PRINTING

This application is the U.S. National Phase under 35 U.S.C. §371 of International Application PCT/JP02/13572, filed on Dec. 26, 2002, which claims priority of Japanese Patent Application No. 2001-393488, filed on Dec. 26, 2001. The International Application was published under PCT Article 21(2) in a language other than English.

FIELD OF THE INVENTION

The present invention relates to a coated printing paper, and in particular to a dull coated printing paper that is bulky (low in density) and yet offers excellent pliability, superior surface smoothness, high degree of print gloss, and minimal small-scale gloss variations in the image area

DESCRIPTION OF PRIOR ART

Concurrent with the advanced visual and color features of printed materials in recent years, there has been an increased demand for printing papers having higher quality. A demand for papers having excellent color reproducibility and glossiness in the image area has been increased because of an increased use of multiple color printing not only for high grade art prints, catalogues, brochures, calendars and the like, which conventionally require a high quality printing finish, but also for photographs, maps and the like, for example, in guidebooks for travel information and gourmet information, so-called "mook" in Japan.

For these papers, the high degree of print gloss is required to provide high grade printing quality while the degree of sheet gloss must be suppressed to be low to restore readability in the non-image area. Therefore, dull coated papers having a degree of sheet gloss within the range of about 35–60% are more preferable than conventional gloss coated papers that have a higher degree of sheet gloss. Further, there is a demand for weight reduction in printed materials for the sake of reduced costs in transportation and mailing. While light weight paper is preferable for guidebooks or the like because they are often read on trip or away from home, there is a demand for the feeling of bulk expected for such books with high quality printings.

The two demands for bulkiness and high printing quality have been mutually contradictory, given that high-quality coated printing papers are generally characterized by higher basis weight of the base paper and greater coating weight, as well as higher density for a given basis weight due to smoothing process by calendering. A paper with a lower basis weight may be selected in order to reduce the weight of a printed material; however, that is not an ideal solution since using such a means of weight reduction without changing the density will result in thinner paper and diminish the feeling of bulk expected of a book.

On the other hand, the basis weight of a base paper may be increased in order to increase thickness of the paper to create the feeling of bulk; however, coatability of a coating layer on the base paper is impaired because the amount of coating has to be reduced to maintain the standard basis weight.

As a result, small-scale gloss variations are generated in the image area, which markedly damage printing quality. Thus, it has been extremely difficult to produce high-quality coated papers which provide higher bulk in other words, which offer greater paper thickness at a given basis weight or a lower basis weight at a given paper thickness, and satisfy the requirement for coated papers to be used for higher grade printing applications, using conventional technology.

Recently, there has also been a trend of public preference for small-size, handy information magazines, called pocket guides in Japan. Pliability is one of the important features required of papers used for these publications. If a rigid paper is used for such magazines, the smaller the size of the book becomes, the more easily the pages will stand straight as they are flipped up and over, making it extremely inconvenient to open and read the book while holding it with one hand, for example, when one is on the road or away from home.

One of the indicators to show the level of paper pliability is measured using a Clark stiffness tester. Paper stiffness increases in proportion to the cube of the paper thickness. If the paper thickness is increased to gain higher bulk at a given basis weight, the paper stiffness increases accordingly. Thus, it has been extremely difficult to obtain a paper that offers excellent pliability and higher bulk at the same time.

The possible means of achieving higher bulk include producing a bulky coated base paper through the use of a bulky pulp and a bulky filler material and reducing the coating weight of a liquid coating composition.

Pulps for paper making are generally classified into chemical pulps and mechanical pulps. Chemical pulps are produced using chemicals that extract the lignin from the fibers. Mechanical pulps, which are made without the use of chemicals, include the ground wood pulp that is produced by grinding wood chips with a grinder and the thermo-mechanical pulp that is made by crumbling wood chips into fibers in a refiner. Generally, the mechanical pulp has stiffer fibers than the chemical pulp and is therefore more effective in providing lower density.

However, use of the mechanical pulp will result in regulatory problems if it is blended in a high quality paper and will easily cause printing defects such as picking due to shives if it is blended in a medium quality paper. Thus, there is a limit to the amount of mechanical pulp that can be used in the paper.

Furthermore, pulp from recycled paper is increasingly being used due to the recent public trend toward environmental preservation and the need to protect natural resources. Generally, however, recycled paper pulp is often produced by mixing fine paper, newsprint, magazine paper, coated papers and other used papers, and thus has a higher density than virgin mechanical pulp (unused pulp that has never made into paper).

As explained above, it is difficult to achieve sufficient paper bulk by working solely with pulp factors, especially when one considers the preservation of wood resources and the quality design of paper. Moreover, a simple blending of the abovementioned pulps for the sake of higher bulk results in greater stiffness, which makes it impossible to obtain sufficient pliability in the paper.

An example of the use of a bulky filler material in the base paper for use in a coated stock, in order to achieve higher bulk is described in Japanese Patent Application Laid-open No. 5-339898, which discloses a technique used to achieve lower density through the blending of hollow synthetic organic capsules. However, such synthetic organic matter degrades the paper strength and causes printing problems such as picking and tearing, while a greater percentage of said matter needs to be blended to achieve a sufficient bulk effect, resulting in a higher production cost A method with the use of Shirasu-balloons is proposed in Japanese Patent Publication No. 52-39924. However, the Shirasu-balloons do not mix well with the pulp, and the paper blended with them causes print mottle and other problems. Further, it is also impossible to achieve pliability in the paper even through the use of any of the techniques discussed above.

A coating layer of a coated paper generally has higher density than that of a base paper. Therefore, a coated paper has higher density than a printing paper without the coating layer. A coated paper with higher bulk may be obtained by applying a smaller amount of coating composition. This is due to a smaller percentage of the coating layer relative to the overall coated paper.

However, there has been a limit to the use of the coating layer in a smaller percentage as a means of reducing the amount of coating while maintaining the target quality since it will also diminish the coverage of the base paper by the coating layer, thereby reducing the printing quality such as sheet gloss, smoothness and print gloss and markedly reducing printing quality by generating small-scale gloss variations in the image area.

Methods of manufacturing regular dull coated papers are mainly intended to minimize sheet gloss, and therefore have used coatings blended with pigments having larger mean particle size. For example, the pigments mainly used in the coating disclosed in Japanese Patent Application Laid-open No. 8-60597 feature larger mean particle size and include 30 parts by weight of Eskalon 1500, ground calcium carbonate (mean particle size: 1.65 μm) and 50 parts by weight of Hydrasperse, US No. 2 kaolin (mean particle size: 1.61 μm), thereby making it difficult to increase the smoothness, sheet gloss and print gloss of the paper to the respective target levels.

Means to solve the problem of insufficient contact between paper and plate surface upon printing and to improve printability have been reported in Japanese Patent Application Laid-open No. 2000-345493 in which a matte paper is produced by forming a coating layer with a pigment having a volumetric particle size distribution of more than 65% within the range of 0.4 to 4.2 μm on a base paper containing 10 parts or more by weight of mechanical pulp as a pulp for paper making and 3 to 12% by weight of paper of amorphous silica as a filler and then treating using a soft nip calender at 150° C. or higher; and in Japanese Patent No. 3093200 in which a bulky coated paper is produced by admixing a polyhydric alcohol and fatty acid ester compound (A) or a polyhydric alcohol ester compound, said ester compound having alkylene groups having 2 to 4 carbons in less than 12 moles per mole of said ester compound (B) to base paper for coating. Further, Japanese Patent Application Laid-open No. 2001-234497 has reported that a paper that provides higher bulk, excellency in paper texture and ease of flipping pages, no web break upon printing, excellent printability, and superior pliability can be produced by setting the product of three factors, i.e., the paper density, breaking length in the machine direction and Young's modulus in the machine direction to be $2\times10^{18}$ to $10\times10^{18}$ $N/m^4$.

However, as mentioned above, it has been difficult to obtain a coated printing paper that provides higher bulk (lower density), yet excellent pliability, mimm small-scale gloss variations in the image area in despite of low sheet gloss, along with great runnability 6with the printing machinery. Further, Japanese Patent Application Laid-open No. 2002-138392 has proposed a matte coated printing paper that provides higher bulk excellent pliability, low incidence of web break upon printing and minimal small-scale gloss variations by using a pigment having a volumetric particle size distribution of 65% or more within the range of 0.4 to 4.2 μm and setting the product of four factors, i.e., the paper basis weight, paper density, breaking length in the machine direction and Young's modulus to be $1.0\times10^{21}$ to $4\times10^{21}$ $g^2\cdot N/m^6$; however, the level of sheet gloss is as low as about 30% or less and thus no dull coated paper has been obtained.

As described above, it has been impossible to obtain a dull coated printing paper that is bulky (low in density) and yet offers excellent pliability, superior surface smoothness, high degree of print gloss and minimal small-scale gloss variations in the image area, using conventional techniques singly or in combination.

DISCLOSURE OF THE INVENTION

Under the abovementioned circumstance, an object of the present invention is to provide a dull coated printing paper that is bulky and yet offers excellent pliability, superior surface smoothness, high degree of print gloss and minimal small-scale gloss variations in the image area.

The present inventors have carried out extensive studies under the challenging circumstances described above, and as a result, have found that a dull coated printing paper that is bulky and yet offers excellent pliability, superior surface smoothness, high degree of print gloss and minimal small-scale gloss variations in the image area can be obtained by forming a coating layer containing a pigment and a binder on a base paper which contains an organic compound having an action to inhibit binding between pulp fibers, and then treating using a calender to set the density of the coated paper to be 0.90 to 1.15 $g/cm^3$.

In conducting studies of the bulky dull coated paper, the present inventors directed their attention to a compound having an action to inhibit binding between pulp fibers. The inventors found that the pliability could be improved while maintaining the bulkiness of the base paper by blending the compound. However, the means of forming a coating layer on the base paper alone did not provide a dull coated paper that offers superior surface smoothness and high degree of print gloss to be expected in the present invention and caused a problem generating small-scale gloss variations in the image area. Therefore, the present inventors studied the use of calendering.

In the present invention, it was found that calendering markedly improved the surface smoothness and degree of print gloss in the coating paper in which the coating was made on the base paper containing an organic compound having an activity to inhibit binding between pulp fibers as compared to the corresponding coated paper in which the coating was made with the same coating layer in the same amount on the base paper without the compound. On the other hand, the calendering reduced the bulking effect due to blending of the organic compound to inhibit binding between pulp fibers, which resulted in that the similar density was observed in the coated paper in which the coating was made on the base paper containing an organic compound having an activity to inhibit binding between pulp fibers and the coresponding coated paper in which the coating was made with the same coating layer in the same amount on the base paper without the compound.

Thus, the present inventors have found that while maintaining the bulkiness due to the blending of an organic compound having an action to inhibit binding between pulp fibers, by setting the density of coated paper to be 0.90 to 1.15 $g/cm^3$, a dull coated paper that is bulky and highly pliable and offers better surface smoothness, higher degree of print gloss and smaller small-scale gloss variations in the image area as compared to a coated paper. coated on a base paper without the blending can be obtained.

In the present invention, organic compounds having an action to inhibit binding between pulp fibers are selected by the following test.

A paper was made using a pulp slurry in which 0.3 part by weight, based on 100 parts by weight of dry pulp, of an organic compound to be tested was blended into a pulp composition to construct a targeted paper using an orientable test paper machine for laboratory use (Kumagai Riki Kogyo) at an operation speed of 900 rpm, and pressing and drying were carried out in accordance with the method of JIS 8209.

The drying was carried out at 50° C. for 1 hour using a blow dryer. The resulting test paper was allowed to stand at 23° C. under an atmosphere of 50% relative humidity for 24 hours, and then tensile strength was measured in accordance with the method of JIS P 8113. A compound with which the tensile strength decreases is an organic compound having an action to inhibit binding between fibers according to the present invention.

A compound with which the rate of decrease in the tensile strength is too low has small bulking effect so that it has to be added in a large quantity. A compound with which the rate of decraase is high can provide significant bulking effect in a small amount added.

Accordingly, any organic compound that decreases tensile strength can be used; however, as to the rate of decrease, 5 to 30% is preferable and 8 to 20% is most preferable when added at 0.3% level.

An organic compound having an action to inhibit binding between pulp fibers of the present invention (herein after referred to as "binding ihbitor") is a compound having a hydrophobic group and a hydrophilic group and showing an activity to decease the tensile strength in the test as described above.

Agents to lower the density (or bulking agents) recently marketed for bulking papers in paper manufacturing are suitable as binding inhibitors of the present invention; for example, those described in WO98/03730, Japanese Patent Application Laid-open No. 11-200284, and Japanese Patent Application Laidpen No. 11-350380 can be used, which include ethylene and/or propylene oxide adducts of higher alcohols, polyhydric alcohol-type nonionic surfactants, ethylene oxide adducts of higher fatty acids, ester compounds of polyhydric alcohols and fatty acids, ethylene oxide adducts of ester compounds of polyhydric alcohols and fatty acids, fatty acid amides, hydroxyethyl derivatives of fatty acid amides, and fatty acid polyamide amines, preferably ester compounds of polyhydric alcohols and fatty acids, propylene oxide adducts of higher alcohols, and hydroxyethyl derivatives of fatty acid amides.

Examples of commercially available bulking agents include Sursol VL by BASF, Bayvolume P Liquid by Bayer, KB-08T, 08W, KB110, 115 by Kao Corporation, and Reactopaque by Sansyo. They can be used singly or in combination of two or more.

A dull coated printing paper of the present invention contains preferably 0.1 to 10 parts by weight, more preferably 0.2 to 1.0 parts by weight, of a pulp binding inhibitor per 100 parts by weight of pulp, in order to make the paper bulky and pliable.

BEST MODE FOR CARRYING OUT THE INVENTION

Other than an organic compound having an action to inhibit binding between pulp fibers, ordinary pulp, fillers and the like are blended in a base paper of the present invention. The kind or the like of the pulps to be blended in the present invention is not particularly limited. For example, hardwood bleached kraft pulp (hereinafter referred to as "LBKP"), softwood bleached karft pulp (hereinafter referred to as "NBKP"), thermo-mechanical pulp, ground wood pulp, and recycled pulp can be used.

Examples of fillers to be blended in a base paper include those known to skilled in the art, such as ground calcium carbonate, precipitated calcium carbonate, kaolin, clay, talc, hydrated silicic acid, white carbon, titanium dioxide and synthetic resin fillers.

The amount of filler to be used is preferably 6% or more by weight of pulp. Further, aluminum sulfate, sizing agents, paper strengthening agents, retention aiding agents, coloring pigments, dyes, antifoaming agents, and the like can be added if necessary.

A method of making a base paper is not particularly limited A base paper can be produced by an acid, neutral or alkline paper making system using a Fourdrinier machine, cylinder machine, or the like including a top wire type paper machine; of course, a medium quality base paper containing mechanical pulp and a base paper containing recycled paper pulp can be used.

Further, in order to improve surface treatment and sizing properties, a surface treatment agent containing water-soluble polymers as a major component can be coated on a base paper. The water-soluble polymers can be those generally used as a surface treating agent, such as oxidized starch, hydroxyethyl etherified starch, enzyme-denatured starch, polyacrylamide, and polyvinyl alcohol. They can bed used singly or as a mxture thereof.

In addition to the water-soluble polymer, a paper strengthening agent to improve water resistance and surface strength and a sizing additive to provide sizing properties may be added to a surface treatment agent The surface treatment agent can be applied using a coating machine, such as a two-roll size press coater, gate roll coater, blade-metering size press coater, rod-metering size press coater, and film tansfer roll coater such as Symsizer and JF sizer. The basis weight of a base paper used for a coated printing paper in the present invention is preferably 30 to 200 g/m$^2$.

Pigments for a coating layer can be those that are conventionally used for coated paper, such as inorganic pigments, e.g., kaolin, clay, delaminated clay, ground calcium carbonate, precipitated calcium carbonate, talc, titanium dioxide, barium sulfate, calcium sulfate, zinc oxide, silicic acid, silicates, colloidal silica and satin white, and organic pigments including plastic pigments, and can be used alone or in combination of 2 or more as necessary.

In order to produce a paper that is bulky and yet in particular offers a degree of sheet gloss ranging from about 35 to 60%, superior print gloss, and reduced small-scale gloss variations in the image area, it is preferable to use kaolin having a particle diameter distribution in which 65% or more of the total have a particle diameter within the range of 0.4 to 4.2 μm on a volumetric basis, and the amount to be blended is preferably 20 to 100 parts by weight, more preferably 40 to 100 parts by weight, most preferably 60 to 100 parts by weight, per 100 parts by weight of pigment The use of a pigment having such a narrow particle size distribution probably enables to form a bulky coating layer having a lower particle packing density, moreover to prevent the entry of the pigment by covering small pores on the surface of the base paper with plate-shaped kaolin particles, and thus to significantly improve coverage of the base paper, which results in a high degree of print gloss and reduction in small-scale gloss variations in the image area.

One or more kinds of kaolin can be selectively used if necessary as long as particles in a coating composition have a volumetric particle size distribution of 65% or more within the range of 0.4 to 4.2 μm.

Binders to be used in the present invention are those conventionally used for coated papers. One or more of the following binders that are conventionally used for coating paper can be appropriately selected: synthetic binders such as styrene/butadiene, styrene/acryl, ethylene/vinyl acetate, butadiene/methyl methacrylate, vinyl acetatelbutylacrylate and other copolymers, polyvinyl alcohol, maleic anhydride copolymers, acrylic acid/methyl methacrylate copolymers; proteins such as casein, soybean proteins and synthetic proteins; starches such as oxidized starch, cationic starch, urea/phosphate esterriled starch, hydroxyethyl etherified starch and other etherified starches, and dextrin; and cellulose derivatives such as carboxymethyl cellulose, hydroxyethyl cellulose and hydroxymethyl cellulose. These adhesives are used within the range of 5 to 50 parts by weight, preferably 5 to 25 parts by weight, to 100 parts by weight of a pigment. Further, a dispersant, thickener, water retention agent, antifoaming agent, water resistant agent, colorant, uprintability improving agent and other auxiliaries commonly used to blend with a pigment composition for coated papers are used as necessary. One or more coating layers are provided on one or both sides of the base paper.

The amount of coating according to the present invention is preferably 5 to 25 g/m$^2$, more preferably 11 to 20 g/m$^2$, on one side.

Coating compositions can be applied to a base paper, using any of known coaters, such as a two-roll size press coater, gate roll coater, blade-metering size press coater, rod-metering size press coater, film transfer roll coater such as Symsizer and JF sizer, flooded nip/blade coater, jet fountain/blade coater, coater with short-dwell-time applicator, a rod-metering coater using a grooved rod or plain rod in stead of the blade, curtain coater and die coater.

In order to improve paper smoothness, print gloss, and small-scale gloss variations in the image area, a coated paper obtained by using the abovementioned techniques is treated with a calender. The calendering is preferably carried out at a line pressure of 50 to 150 kg/cm which is lower than an ordinary line pressure. It is difficult to obtain a dull coating paper providing high smoothness, high print gloss, and minimal microscale gloss variations in the image area as desired in the present invention when the paper is treated at a line pressure of less than 50 kg/cm.

On the other hand, when the line pressure is more than 150 kg/cm, density is greatly increased by calendering and the bulkiness expected in the present invention may not be attained.

The number of roll nips for calender treatment is preferably 2 to 7, more preferably 3 to 5. Calender treatment can be carried using known devices for calender treatment, such as a super calender using cotton rolls as resilient rollers and a soft nip calender using synthetic resin rolls as resilient rollers.

A soft nip calender can be used for high-temperature surface treatment applications. since its synthetic resin rollers can be set to withstand a higher surface temperature than cotton rollers.

Calender treatment can be carried out at as high as 100 to 200° C. using a soft nip calender while a treatment temperature for an ordinary super calender is 50° C. to 90° C.

A soft nip calender is preferable when the same level of smoothness is intended in particular at 160 to 200° C. since its line pressure can be set to a lower level than that of a super calender, thus allowing to obtain a coated paper having a lower density and greater smoothness.

Calender rolls are preferably arranged in tandem, in which 2 rolls are placed as a set on a line, since the effect of the weight of rolls themselves can be minimized in each steps during the treatment.

A targeted quality can be attained using a line pressure specified in the present invention even if a calender has multiple nips of rolls stacked in the vertical or diagonal direction; however, a calender having a structure to independently control nip pressure between mps is preferable since effect of the weight of the rolls themselves can be minimized.

Treatment speed can be within the range of general treatment speed. For example, a super calender can be used with a speed within a range of 200 to 800 m/min depending on the treating capacity because the calender is generally an off-machine device installed separately from a coater. On the other hand, a high-temperature soft nip calender can be installed as an on-machine calender on the rear half of the coater, in such a case, the treating can be carried out faster than at 1000 m/min depending on the production capacity of the coater.

The faster the treating speed, the shorter the passing time between the roll nips; therefore to attain the same targeted smoothness, the line pressure for the treatment has to be set higher than that in low speed treatment, which is not preferable since bulkiness will be lost with a line pressure of higher than 150 kg/cm defined in the present invention.

In the present invention, in order to obtain a dull coated printing paper having high bulliness and excellent printability and other properties, the density of the coated paper is preferably 0.95 to 1.10 g/cm$^3$, more preferably 0.95 to 1.05 g/cm$^3$. Further, the degree of sheet gloss is preferably 35 to 60% and the degree print gloss is preferably 65 to 90%.

As described above, a dull coated printing paper that offers bulkiness (low density) yet excellent pliability, great surface smoothness, superior print gloss, and minimal small-scale gloss variations in the image area can be obtained by forming a coating layer containing a pigment and a binder on a base paper comprising an organic compound having an action to inhibit binding between pulp fibers and then carrying out calender treatment so as to produce the coated paper having a density of 0.90 to 1.15 g/cm$^3$.

EXAMPLES

The present invention will be explained in more detail referring to the following examples and comparative examples; however, these examples and comparative examples are not to be construed to limit the scope of the invention Unless otherwise specified, the part(s) and % used in the examples and comparative examples refer to the part(s) by weight and % by weight, respectively. Coated printing papers obtained were tested in accordance with the methods of evaluation described below:

<Evaluation Methods>

(Measurement of Volumetric Particle Size Distribution for Pigment)

The volumetric particle size distribution was measured using a laser diffraction/dispersed particle size distribution measurement instrument (Mastersizer S manufactured by Malvein Instruments) to calculate the percentage of particles that fell within the range of 0.4 μm to 4.2 μm (Basis Weight)

Measured in accordance with JIS P 8124: 1998.

(Density)

Measured in accordance with JIS P 8118: 1998.

(Coating Coverage)

A coated paper was immersed in a burnout test solution (2.5% ammonium chloride, 50% isopropyl alcohol aqueous solution) for 2 minutes, allowed to airdry, then heated for 20 minutes in a blow dryer at 200° C. Ten panelists evaluated the color variations derived from variations in the amount of coating of a sample using a four-level scale: oo—very good; o—good; Δ—slightly poor, and x—poor.

(Sheet Gloss)

Evaluated in accordance with JIS P 8142: 1998.

(Oken Type Smoothness)

Measured using an Oken type smoothness tester Japan Tappi No. 5.

(Print Gloss)

Printing was performed using an RI-Il type printing tester with 0.30 ml of sheet-fed process ink manufactured by Toyo Ink Mfg. Co., Ltd. (product name: TK HYECOO Magenta MZ), the test sample was allowed to stand for 24 hours, and then the surface of the printed material obtained was measured in accordance with JIS P 8142: 1998.

(Gloss Variations)

Small-scale gloss variations on the surface of white paper were evaluated by 10 panelists using a four-level scale: oo—very good; o—good; Δ—slightly poor, and x—poor.

(Pliability: Ease of Flipping Pages)

A book model was made by chp-binding 100 sheets of blank paper cut to A5 size, and 10 panelists evaluated the ease of flipping pages according to a four-level scale: oo—very good; o —good; Δ—somewhat difficult; and x—difficult.

(Selection of Binding Inhibitors)

A 1% slurry was prepared using 30 parts of NBKP and 70 parts of refiner ground pulp (RGP), and 0.3 part of each of compounds shown below was admixed to this slurry to prepare paper stock. This paper stock was niade into paper using an oriented test machine for laboratory use by Kumagai Rild Kogyo at an operation speed of 900 rpm, and pressing and drying were carried out according to the method of JIS 8209. The drying was carried out at 50° C. for 1 hour using a blow dryer to obtain a paper for the test. This test paper was allowed to stand at 23° C. for 24 hours under an atmosphere of 50% relative humidity, and then the tensile strength was measured in accordance with JIS P 8113.

Results of measurements are shown in Table 1.

TABLE 1

| Chemicals to be evaluated | Tensile strength (KN/m) | Tensile strength reduction (%) | Binding inhibitability |
|---|---|---|---|
| KB-08W (Kao) | 1.53 | 13.7 | o |
| KB-110 (Kao) | 1.50 | 14.8 | o |
| Surzol VL (BASF) | 1.56 | 9.8 | o |
| Bayvolume P Liquid (Bayer) | 1.59 | 9.7 | o |
| Reactopaque (Sansho) | 1.63 | 7.4 | o |
| Isopropyl alcohol | 1.73 | 1.7 | Δ |
| Starch | 1.85 | −5.1 | x |
| Casein | 1.89 | −7.4 | x |
| Polyethylene glycol | 1.73 | 1.7 | Δ |
| Oleic acid | 1.66 | 5.7 | Δ |
| Polyacrylamide | 2.00 | −13.6 | x |
| None | 1.76 | — | — |

The test above reveals that compounds showing a reduction in tensile strength of more than 6% are preferable and those showing a reduction in tensile strength of more than 10% is particularly suitable for the present invention.

Next, KB-110 by Kao Corporation, which showed excellent binding inhibitability in the test above, was used to make a dull coated printing paper for evaluation.

Example 1

A dull coated printing paper was obtained by applying a liquid coating, which was prepared by adding 0.1 part by weight of sodium polyacrylate as a dispersant and 11 parts by weight of carboxyl-modified styrene butadiene latex and 4 parts by weight of phosphate esterified starch as binders to a pigment comprising 40 parts by weight of ground calcium carbonate (a product of Fimatec, FMT 90, volumetric particle size distribution: 0.40 to 4.20 μm, 71.7%) and 60 parts by weight of Brazilian kaolin (a product of Rio Capim, Capim DG, volumetric particle size distribution: 0.40 to 4.20 μm, 71.7%) and then adjusting the coating solid to 65% by weight with an addition of water, onto both sides of a base paper having a basis weight of 125 g/m$^2$ using a blade coater at a coating speed of 500 m/min so that 15 g/m$^2$ of the coating could be applied to each side, and then treating the resultant coated paper in 5 steps at a treating speed of 400 m/min, a line pressure of 75 kg/cm, and a metal roll surface temperature of 65° C. using a 12-roll super calender comprising metal rolls and cotton rolls.

Example 2

A dull coated printing paper was obtained in the same manner as described in Example 1, except that a pigment used comprised 20 parts by weight of ground calcium carbonate (a product of Fimatec, FMT 90, volumetric particle size distribution: 0.40 to 4.20 μm, 71.7%) and 80 parts by weight of Brazilian kaolin (a product of Rio Capim, Capim DG, volumetric particle size distribution: 0.40 to 4.20 μm, 71.7%).

Example 3

A coated paper was produced by applying a liquid coating, which was prepared by adding 0.1 part by weight of sodium polyacrylate as a dispersant and 11 parts by weight of carboxyl-modified styrene butadiene latex and 4 parts by weight of phosphate esterified starch as binders to a pigment comprising 70 parts by weight of ground calcium carbonate (a product of Fimatec, FMT 90, volumetric particle size distribution: 0.40 to 4.20 μm, 71.7%) and 30 parts by weight of fine kaolin (a product of Engelhard, Mirasheen, volumetric particle size distribution: 0.40 to 4.20 μm, 60.2%) and then adjusting the coating solid to 65% by weight with an addition of water, onto both sides of a base paper comprising 100 parts by weight of chemical pulp as paper pulp, 12 parts by weight of precipitated calcium carbonate as a filler, and 0.3 part by weight of KB-110 by Kao Corporation as a binding inhibitor and having a basis weight of 61 g/m$^2$, using a blade coater at a coating speed of 800 m/min so that 15 g/m$^2$ of the coating could be applied to each side. The resultant coated paper was treated in 3 steps at a treating speed of 550 m/min, line pressure of 75 kg/cm, and a metal roll surface temperature of 65° C. using a 12-roll super calender comprising metal rolls and cotton rolls to obtain a dull coated printing paper.

Example 4

A dull coated printing paper was obtained in the same manner as described in Example 3, except that the line pressure for the treatment was 30 kg/cm.

Comparative Example 1

A dull coated printing paper was obtained in the same manner as described in Example 3, except that a base paper comprising 100 parts by weight of chemical pulp as paper pulp and 12 parts by weight of precipitated calcium carbonate as a filler and having a basis weight of 61 g/m$^2$ was used.

Comparative Example 2

A dull coated printing paper was obtained in the same manner as described in Example 3, except that no calender treatment was carried out Comparative Example 3

A dull coated printing paper was obtained in the same manner as described in Comparative Example 1, except that no calender treatment was carried out.

Comparative Example 4

A dull coated printing paper was obtained in the same manner as described in Example 3, except that the line pressure for the treatment was 200 kg/cm.

Comparative Example 5

A dull coated printing paper was obtained in the same manner as described in Example 3, except that a pigment comprising 30 parts by weight of ground calcium carbonate (a product of Fimatec, FMF 90, volumetric particle size distribution: 0.40 to 4.20 μm, 71.7%) and 70 parts by weight of fine kaolin (a product of Engelhard, Miheen, volumetric particle size distribution:

0.40 to 4.20 μm, 60.2%) was applied in an amount of coating of 10 g/m$^2$ on each side and the resultant coated paper was treated in 11 steps at a line pressure of 200 kg/cm.

The dull coated printing papers produced under the conditions above were evaluated for the basis weight, paper thickness, density, coating coverage on the base paper, sheet gloss, Oken type smoothness, print gloss, gloss variations in the image area, and pliability of paper. Results are shown in Table 2.

TABLE 2

| | Example 1 | Example 2 | Example 3 | Example 4 |
|---|---|---|---|---|
| Binding inhibitor (%) | 0.3 | 0.3 | 0.3 | 0.3 |
| Pigment (parts) | | | | |
| Ground calcium carbonate; FMT90 | 40 | 20 | 70 | 70 |
| Ground calcium carbonate; Eskalon 1500 | | | | |
| Kaolin; Mirasheen | | | 30 | 30 |
| Kaolin; Capim DG | 60 | 80 | | |
| Coating on one side (g/m$^2$) | 15 | 15 | 15 | 15 |
| Surface treatment line pressure (kg/cm) | 120 | 120 | 75 | 30 |
| Surface treatment nips (steps) | 5 | 5 | 3 | 3 |
| Basis weight (g/m$^2$) | 155 | 156.5 | 91.6 | 91.8 |
| Paper thickness (μm) | 153 | 152 | 82 | 88 |
| Density (g/cm$^3$) | 1.01 | 1.03 | 1.12 | 1.04 |
| Coating coverage* | ○○ | ○○ | ○ | ○ |
| Sheet gloss (front/back, %) | 53/55 | 60/60 | 46/44 | 40/36 |
| Oken type smoothness (front/back, sec) | 1800/1900 | 2400/2200 | 1200/1100 | 780/700 |
| Print gloss (front/back, %) | 75/78 | 80/82 | 72/71 | 68/65 |
| Image area small-scale gloss variations* | ○○ | ○○ | ○ | Δ |
| Pliability* | ○ | ○ | ○ | ○ |

| | Comparative Example | | | | |
|---|---|---|---|---|---|
| | 1 | 2 | 3 | 4 | 5 |
| Binding inhibitor (%) | none | 0.3 | none | 0.3 | 0.3 |
| Pigment (parts) | | | | | |
| Ground calcium carbonate; FMT90 | 70 | 70 | 70 | 70 | 70 |
| Ground calcium carbonate; Eskalon 1500 | | | | | |
| Kaolin; Mirasheen | 30 | 30 | 30 | 30 | 30 |
| Kaolin; Capim DG | | | | | |
| Coating on one side (g/m$^2$) | 15 | 15 | 15 | 15 | 15 |
| Surface treatment line pressure (kg/cm) | 75 | none | none | 30 | 200 |
| Surface treatment nips (steps) | 3 | none | none | 3 | 3 |
| Basis weight (g/m$^2$) | 92.4 | 92.2 | 92.8 | 91.8 | 92.2 |
| Paper thickness (μm) | 78 | 104 | 93 | 88 | 77 |

TABLE 2-continued

| | | | | | |
|---|---|---|---|---|---|
| Density (g/cm$^3$) | 1.18 | 0.89 | 1.00 | 1.04 | 1.20 |
| Coating coverage* | ○ | ○ | ○ | ○ | ○ |
| Sheet gloss (front/back, %) | 42/42 | 30/29 | 31/31 | 40/36 | 47/47 |
| Oken type smoothness (front/back, sec) | 900/950 | 300/300 | 320/310 | 780/700 | 1300/1300 |
| Print gloss (front/back, %) | 68/69 | 55/54 | 56/55 | 68/65 | 73/73 |
| Image area small-scale gloss variations* | ○ | x | x | Δ | ○ |
| Pliability* | Δ | Δ | x | ○ | ○○ |

*Visual evaluation

As shown in Table 2, dull coated printing papers obtained in Examples are bulky yet highly pliable, and offer relatively low sheet gloss, superior surface smoothness, high degree of print gloss and minimal small-scale gloss variations in the image area.

INDUSTRIAL FIELD OF APPLICATION

According to the present invention, dull coated printing papers that are bulky (low in density) yet highly pliable and offer superior surface smoothness, high degree of print gloss and minimal small-scale gloss variations in the image area can be obtained.

The invention claimed is:

1. A dull coated printing paper which has a density of 0.90 to 1.15 g/cm$^3$ adjusted by calender treatment, comprising:

a base paper formed with pulp fibers and containing an organic compound having an action to inhibit binding between the pulp fibers, said organic compound being selected from the group consisting of ethylene and/or propylene oxide adducts of higher alcohols, polyhydric alcohol-type nonionic surfactants, ethylene oxide adducts of higher fatty acids, ester compounds of polyhydric alcohols and fatty acids, ethylene oxide adducts of ester compounds of polyhydric alcohols and fatty acids, fatty acid amides, hydroxyethyl derivatives of fatty acid amides, and fatty acid polyamide amines; and a coating layer formed on the base paper, comprising a pigment and an adhesive.

2. The dull coated printing paper according to claim 1, wherein the line pressure for said calender treatment is 50 to 150 kg/cm.

3. The dull coated printing paper according to claim 1, wherein the degree of sheet gloss is 35 to 60% and the degree of print gloss is 65 to 90%.

4. The dull coated printing paper according to claim 1, wherein said organic compound having an action to inhibit binding between pulp fibers is an organic compound which causes a decrease in the tensile strength of a base paper comprising 0.3 part by weight of said organic compound admixed with 100 parts by weight of bone dry pulp, at a rate of decrease of 5 to 30% as compared to the tensile strength of a base paper without the admixing of said organic compound.

5. The dull coated printing paper according to claim 1, wherein said pigment in said coating layer comprises 20 to 100 parts by weight of kaolin having a volumetric particle size distribution of 65% or more within the range of 0.4 to 4.2 μm per 100 parts by weight of the pigment.

6. The calender-treated dull coated printing paper according to claim 1, wherein the organic compound is a compound which provides a decrease of 5–30% in tensile strength when 0.3 part by weight of the organic compound is admixed with 100 parts by weight of bone dry pulp, as compared to the tensile strength of the base paper without the organic compound.

7. The dull coated printing paper according to claim 1, wherein the organic compound is selected from the group consisting of ester compounds of polyhydric alcohols and fatty acids, propylene oxide adducts of higher alcohols, and hydroxyethyl derivatives of fatty acid amides.

8. The dull coated printing paper according to claim 1, wherein the coating layer is applied in an amount of 5 to 25 g/m$^2$.

9. The dull coated printing paper according to claim 1, wherein the coating layer is applied in an amount of 11 to 20 g/m$^2$.

10. The dull coated printing paper according to claim 1, wherein the organic compound is contained in an amount of 0.1 to 10 parts by weight per 100 parts by weight of the pulp fibers.

11. The dull coated printing paper according to claim 1, wherein the organic compound is contained in an amount of 0.2 to 1.0 parts by weight per 100 parts by weight of pulp.

12. A method for producing a dull coated printing paper, comprising:

providing a base paper comprising an organic compound having an action to inhibit binding between pulp fibers, said organic compound being selected from the group consisting of ethylene and/or propylene oxide adducts of higher alcohols, polyhydric alcohol-type nonionic surfactants, ethylene oxide adducts of higher fatty acids, ester compounds of polyhydric alcohols and fatty acids, ethylene oxide adducts of ester compounds of polyhydric alcohols and fatty acids, fatty acid amides, hydroxyethyl derivatives of fatty acid amides, and fatty acid polyamide amines;

forming a coating layer comprising a pigment and an adhesive on the base paper; and conducting calender treatment to produce the coated printing paper to provide a density of 0.90 to 1.15 g/cm$^3$.

13. The method according to claim 12, wherein the line pressure for said calender treatment is 50 to 150 kg/cm.

14. The method according to claim 12, wherein the printed paper has a degree of sheet gloss is 35 to 60% and the degree of print gloss is 65 to 90%.

15. The method according to claim 12, wherein 0.3 part by weight of the organic compound is admixed with 100 parts by weight of bone dry pulp to provide a decrease of 5–30% in tensile strength as compared to the tensile strength of the base paper without the organic compound.

16. The method according to claim 12, wherein the pigment in the coating layer comprises 20–100 parts by weight of kaolin having a volumetric particle size distribution of 65% or more within a range of 0.4–4.2 μm per 100 parts by weight of the pigment.

17. The method according to claim 12, wherein the selection of the organic compound comprises measuring a decrease of an organic compound in tensile strength when 0.3 part by weight of the organic compound is admixed with 100 parts by weight of bone dry pulp, as compared to the tensile strength of the base paper without the organic compound, and selecting the organic compound if the decrease is 5–30%.

18. The method according to claim 12, wherein the calendering treatment is performed by a soft nip calender at a temperature of 100° C. to 200° C.

19. The method according to claim 12, wherein the calendering treatment is performed by a soft nip calender at a temperature of 160° C. to 200° C.

20. The method according to claim 12, wherein the number of roll nips for the calender treatment is 2 to 7.

21. The method according to claim 12, wherein the number of roll nips for the calender treatment is 3 to 5.

* * * * *